US006613127B1

(12) United States Patent
Galloway et al.

(10) Patent No.: US 6,613,127 B1
(45) Date of Patent: Sep. 2, 2003

(54) QUENCH APPARATUS AND METHOD FOR THE REFORMATION OF ORGANIC MATERIALS

(75) Inventors: Connie M. Galloway, Angleton, TX (US); Kenneth W. Mall, Lake Jackson, TX (US); Dennis W. Jewell, Angleton, TX (US); William M. Eckert, Angleton, TX (US); Leopoldo L. Salinas, III, Lake Jackson, TX (US); Ed E. Timm, Freeland, MI (US)

(73) Assignee: Dow Global Technologies Inc., Midland, MI (US)

( * ) Notice: Subject to any disclaimer, the term of this patent is extended or adjusted under 35 U.S.C. 154(b) by 0 days.

(21) Appl. No.: 09/566,297

(22) Filed: May 5, 2000

(51) Int. Cl.[7] ..... B01D 47/00

(52) U.S. Cl. ..... 95/149; 48/69; 48/128; 48/197 R; 48/206; 95/228; 96/272; 96/322; 261/95; 261/99; 261/104; 261/107; 422/207

(58) Field of Search ..... 95/149, 228; 96/272, 96/273, 270, 277, 280, 322; 422/207; 48/69, 77, 128, 206, 197 R, DIG. 2; 261/100, 106, 107, 95, 99, 104

(56) References Cited

U.S. PATENT DOCUMENTS 3,315,005 A * 4/1967 Billi
3,364,982 A 1/1968 Jaffe (List continued on next page.)

FOREIGN PATENT DOCUMENTS

| | | |
|---|---|---|
| DE | 196 22 976 A1 | 12/1997 |
| FR | 2 022 196 | 7/1970 |
| FR | 2 373 498 | 7/1978 |
| GB | 1 206 642 | 9/1970 |
| GB | 1 431 525 | 4/1976 |
| JP | 2000005542 | 1/2000 |
| WO | WO 99/32397 | 7/1999 |

OTHER PUBLICATIONS

Guffey II, G.E., "Sizing Up Heat Transfer Fluids & Heaters", Chemical Engineering, Oct. 1997, p. 126, vol. 104, No. 10.

Kaferle, Jr., J.A., "Calculating Pressures for Dimple Jackets", Chemical Engineering, Nov. 24, 1975, p. 86, vol. 82, No. 25.

Kuhre and Shearer, "Syn Gas From Heavy Fuels", Hydrocarbon Processing, Dec. 1971, p. 113.

Joshi, Gupta, Singh and Srivastava, Characterization of Carbon Obtained From Naphtha Gasification Unit, Fertilizer Technology, 1978, p. 176, vol. 15, No. 2.

Lehrer, I.H., "Jacket–Side Nusselt Number", Ind. Eng. Chem. Process Des. Develop., 1970, p. 553, vol. 9, No. 4.

(List continued on next page.)

*Primary Examiner*—Duane S. Smith
(74) *Attorney, Agent, or Firm*—Tai-Sam Choo; W. B. Miller; Sue Z. Shaper

(57) ABSTRACT

Methods and apparatus for processing and cooling a hot gaseous stream exiting a gasification reactor vessel at temperatures in excess of 1300° C. where the gas will come into contact with a corrosive aqueous liquid, including methods and apparatus for cooling the gaseous stream prior to quenching the gaseous stream as well as methods and apparatus for providing vessel construction able to provide for the contact of a hot gaseous stream at temperatures in excess of 1100° C. with a corrosive aqueous liquid.

24 Claims, 12 Drawing Sheets

U.S. PATENT DOCUMENTS

| | | | | |
|---|---|---|---|---|
| 3,847,564 | A | | 11/1974 | Marion et al. |
| 3,945,942 | A | | 3/1976 | Marion et al. |
| 4,087,497 | A | | 5/1978 | Opitz et al. |
| 4,097,679 | A | | 6/1978 | Fukumoto et al. |
| 4,338,099 | A | | 7/1982 | Crouch et al. |
| 4,351,645 | A | | 9/1982 | Marion et al. |
| 4,364,744 | A | | 12/1982 | Crouch et al. |
| 4,371,379 | A | | 2/1983 | Brent et al. |
| 4,444,726 | A | * | 4/1984 | Crotty, Jr. et al. |
| 4,466,808 | A | | 8/1984 | Koog |
| 4,474,584 | A | * | 10/1984 | Koog |
| 4,494,963 | A | * | 1/1985 | Reich |
| 4,552,727 | A | | 11/1985 | Schuchardt et al. |
| 4,650,497 | A | * | 3/1987 | Quintana |
| 4,705,542 | A | * | 11/1987 | Gilmer |
| 4,762,532 | A | | 8/1988 | Lipp |
| 4,778,483 | A | * | 10/1988 | Martin et al. |
| 4,808,197 | A | * | 2/1989 | Ayers |
| 4,828,578 | A | * | 5/1989 | Den Bleyker |
| 4,828,579 | A | * | 5/1989 | Becker et al. |
| 4,828,580 | A | * | 5/1989 | Dach |
| 4,857,076 | A | | 8/1989 | Pearson et al. |
| 4,902,303 | A | * | 2/1990 | Den Bleyker |
| 4,992,081 | A | * | 2/1991 | Den Bleyker |
| 5,122,309 | A | | 6/1992 | Moerer |
| 5,174,368 | A | | 12/1992 | Boury et al. |
| 5,174,865 | A | | 12/1992 | Stultz et al. |
| 5,233,943 | A | | 8/1993 | Martin et al. |
| 5,377,960 | A | | 1/1995 | Leczo et al. |
| 5,397,381 | A | * | 3/1995 | Keintzel et al. |
| 5,458,859 | A | | 10/1995 | Vollhardt |
| 5,931,978 | A | | 8/1999 | Oortwijn et al. |

OTHER PUBLICATIONS

Markovitz, R.E., "Picking the Best Vessel Jacket", Chemical Engineering Nov. 15, 1971, p. 156.

Markovitz, R.E., Chapter: Heat Transfer, Jacketed Vessels Selection and Design, 1991, p. 422, ed. J.J. McKetta, Marcel Dekker.

Reed and Kuhre, "Make Syn Gas by Partial Oxidation", Hydrocarbon Processing, Sep. 1979, p. 191, vol. 58, No. 9.

Schaber, K., "Aerosol Formation in Absorption Processes", Chemical Engineering Science, Apr. 1995, p. 1347, vol. 50–58.

Van Amstel, "New Data on Shell's Syn Gas Process", Petroleum Refiner, Mar. 1960, p. 151, vol. 39, No. 3.

Penney, W.R., "Hemisphere Handbook of Heat Exchanger Design", 1981, Section 3.14 (3.14.1, .2 and .3), G.F. Hewitt.

Nirula, "Synthesis Gas, Supplement A", Report No. 148A, SRI International, Nov. 1995 (copy not enclosed).

* cited by examiner

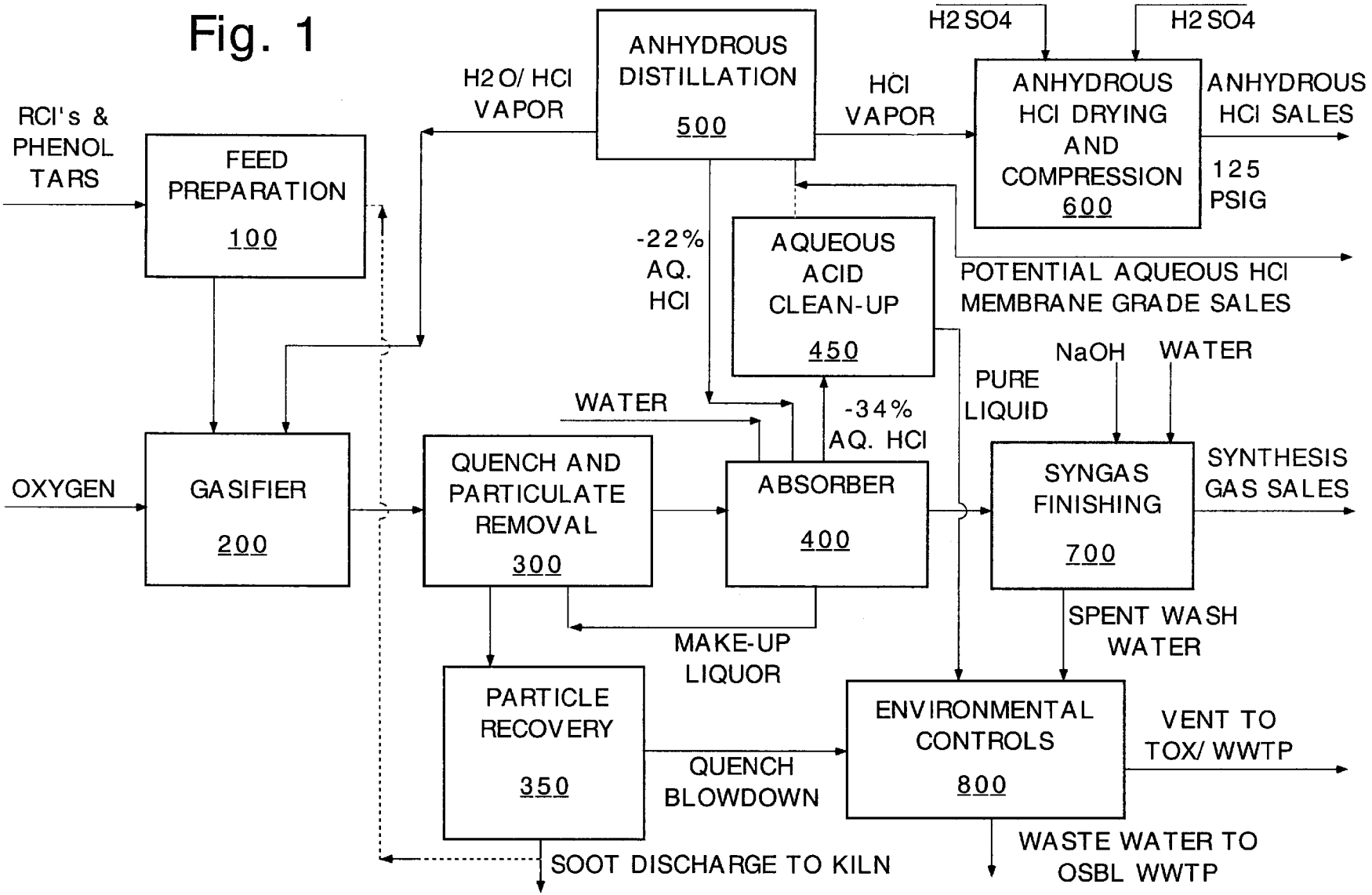
Fig. 1
FEED PREPARATION 100
GASIFIER 200
QUENCH AND PARTICULATE REMOVAL 300
PARTICLE RECOVERY 350
ABSORBER 400
AQUEOUS ACID CLEAN-UP 450
ANHYDROUS DISTILLATION 500
ANHYDROUS HCl DRYING AND COMPRESSION 600
SYNGAS FINISHING 700
ENVIRONMENTAL CONTROLS 800
RCl's & PHENOL TARS
OXYGEN
H2O/ HCl VAPOR
-22% AQ. HCl
WATER
-34% AQ. HCl
MAKE-UP LIQUOR
QUENCH BLOWDOWN
SOOT DISCHARGE TO KILN
HCl VAPOR
H2SO4
H2SO4
ANHYDROUS HCl SALES
125 PSIG
POTENTIAL AQUEOUS HCl MEMBRANE GRADE SALES
PURE LIQUID
NaOH
WATER
SYNTHESIS GAS SALES
SPENT WASH WATER
VENT TO TOX/ WWTP
WASTE WATER TO OSBL WWTP

WEIR QUENCH

QUENCH APPARATUS AND METHOD FOR THE REFORMATION OF ORGANIC MATERIALS

FIELD OF THE INVENTION

The invention relates to methods and apparatus for cooling a hot gas exiting a gasification reactor vessel at temperatures in excess of 1300° C., wherein the gas comes into contact with corrosive aqueous liquid.

BACKGROUND OF THE INVENTION

Related inventions include a prior patent application for a Method and Apparatus for the Production of One or More Useful Products from Lesser Value Halogenated Materials, PCT international application PCT/US/98/26298, published Jul. 1, 1999, international publication number WO 99/32937. The PCT application discloses processes and apparatus for converting a feed that is substantially comprised of halogenated materials, especially by-product and waste chlorinated hydrocarbons as they are produced from a variety of chemical manufacturing processes, to one or more "higher value products" via a partial oxidation reforming step in a gasification reactor. Other related inventions include six co-filed applications for certain other aspects of processes for gasifying materials, the aspects including methods and apparatus for increasing efficiencies, reactor vessel design, reactor feed nozzle designs, producing high quality acids, particulate removal and control of aerosols.

In the reformation of materials, gases tend to exit a reactor, or gasifier, at high temperatures, such as at approximately 1400° C. to 1450° C. Cooling of these gases preferably takes place in a subsequent quench area. Quenching is advantageously achieved in a single contacting step. In such a step preferably a recirculated, cooled aqueous liquid vigorously contacts the hot gases to effect the desired cooling. This contacting step is more preferably performed in a weir quench. The aqueous liquid, as well as the gas, may be corrosive.

A weir quench, in preferred embodiments, is a vessel having one or more short vertical weir cylinder(s) that penetrate a lower flat plate. The lower flat plate forms a partition between an upper and a lower chamber. Quench liquor flows into an annular volume created between side vessel walls and the central cylinder(s), and above the flat plate. The liquor preferably is managed to continually overflow the top of the cylinder(s) and to flow down the inside walls of the cylinder(s). When, simultaneously, a hot gas is directed to flow down through the vessel and through the cylinder(s), into a region below, the co-flow of liquid and the gas, with liquid evaporating as it cools the gas, creates an intimate mixing and cooling of the gas stream. An inventory of liquid around the weir, in such an embodiment, can serve as a reservoir in the event of a temporary interruption of liquid flow.

Liquid overflow of weir quench, as discussed above, can operate in one of three stages, with the middle stage being preferable. In a first stage, a low liquid flow rate could be insufficient to fully wet the ID wall of the weir cylinder(s). In a second and preferred stage, the liquid flow rate is sufficient to fully wet the weir ID, creating a full liquid curtain, but is not so great as to completely fill a cross section of the weir. That is, a gas flow area would still be available down the weir diameter. In a third operating stage liquid flowrate might be so high that a back-up of the liquid occurs, to a point that the weir functions as a submersed orifice.

One problem with using a quench, as discussed above, to cool a very hot gaseous stream by contact with a corrosive liquid, such as is the case with cooling gases from a halogenated material reactor, is in providing suitable materials for the quench vessel walls that will withstand corrosion. Materials must be found that can withstand both the corrosive effect from a hot dry gas environment and also withstand a corrosive liquid aqueous environment. Wall portions exposed to both a corrosive aqueous liquid and a hot gaseous stream are subject to severe corrosive action. Thus, the materials selected for areas of a quench vessel wall that come into contact with a gas/liquid interface are of critical importance. The instant invention provides several methods and apparatus for solving the above materials problems so as to minimize vessel wall corrosion.

SUMMARY OF THE INVENTION

In one aspect, the invention includes a vessel for receiving a gas, at temperatures greater than 1100° C., and contacting the gas with an aqueous corrosive liquid therein, such as aqueous hydrogen halide liquid. The vessel preferably includes upper wall portions lined with a hot face material. A hot face material is generally known in the art and includes materials such as $Al_2O_3$, refractory brick, and refractory materials capable of withstanding hot dry temperatures such as in the range of 1450° C. The vessel should include a pressure wall or shell and may include a jacketing over the pressure wall or shell to help control exterior vessel wall temperatures, at least for the hottest upper regions of the vessel. Preferably a quench vessel upper region also includes inner lower wall portions comprised of a carbon based material, SiC material or other non-metal materials suitable for containing a corrosive aqueous liquid.

In one embodiment of the instant invention, a membrane wall is located upon an inner vessel wall proximate a liquid/gas interface level. The liquid/gas interface level in a quench may vary somewhat. However, the level should be able to be predicted to within a height range which may run a few feet for some embodiments. A membrane wall is comprised of tubing that provides internal channels for circulating a cooling fluid. Alternately, a carbon block or ring wall can be located upon an inner vessel wall proximate a liquid/gas interface, with the block providing internal passageways for circulating a cooling fluid, like the membrane wall above. With the membrane or carbon block wall, the inner wall surface remains dry.

In a further dry wall embodiment, a SiC, graphite, silica or similar material block or ring is located on the inner vessel wall proximate, above and below a liquid/gas interface. Contact with the liquid below cools upper portions of the block or ring by heat transfer through the material itself such that wetted portions above the interface remain below approximately 1000° C., a temperature at which the material can sufficiently withstand corrosion, notwithstanding contact with the hot gas.

In another embodiment of the instant invention, a graphite ring wall can be located upon an inner vessel wall, proximate a liquid/gas interface level, with the ring in communication with, and having ports for discharging, a cooling fluid therethrough. Such ring and ports are structured to discharge cooling fluid substantially down the inside vessel wall below the ports and above the interface. A graphite ring can include a graphite splash baffle attached to the inner vessel wall and extending inwardly over the ring ports. In an alternate embodiment, the vessel can include a porous seeping ceramic wall (sometimes referred to as a weeping wall) located upon the inner vessel wall proximate a liquid/gas interface level, with the ceramic wall in communication with a source of cooling fluid for communicating a fluid therethrough. The cooling fluid passes through the wall, or seeps through the wall, and down inside wall surfaces, cooling the wall and forming a liquid curtain over inside wall surfaces. Seeping discharge is limited to desired wall surface portions by finishing or coating to an impermeable state ceramic wall surfaces not desired to seep.

In another aspect, the invention includes apparatus for quenching a hot corrosive gaseous stream including a reactor discharging a hot corrosive gaseous stream of at least 1300° C., a quench vessel in fluid communication with the reactor for receiving the gaseous stream and contacting the gaseous stream with an aqueous liquid and a means located between the reactor and the quench vessel for cooling the reactor gaseous stream to below 1100° C. in a dry environment. The means for cooling can include a radiant cooler, a convective cooler or a dry spray quench.

The invention also includes methods for quenching a hot gaseous stream that includes discharging a gaseous stream at temperatures in excess of 1100° C. into a quench vessel, cycling a corrosive aqueous liquid into the quench vessel and cooling vessel wall portions around a liquid/gas interface level with a cooling fluid, the cooling fluid either circulated interior to the wall or discharged over interior wall surfaces. In an alternate embodiment, the invention includes a dry environment method for quenching a hot corrosive gaseous stream comprising discharging a corrosive gaseous stream from a reactor chamber at temperatures greater than 1300° C., cooling discharging gas to below 1100° C. in a dry environment and communicating the cooled discharged gas to a quench vessel for cooling to temperatures of less than 200° C. by contacting the gas with an aqueous liquid.

BRIEF DESCRIPTION OF THE DRAWINGS

A better understanding of the present invention can be obtained when the following detailed description of the preferred embodiment is considered in conjunction with the following drawings, in which:

FIG. 1 is a block flow diagram of an embodiment of a gasification process, in general, for halogenated materials.

DETAILED DESCRIPTION OF THE PREFERRED EMBODIMENTS

Figure 2A:
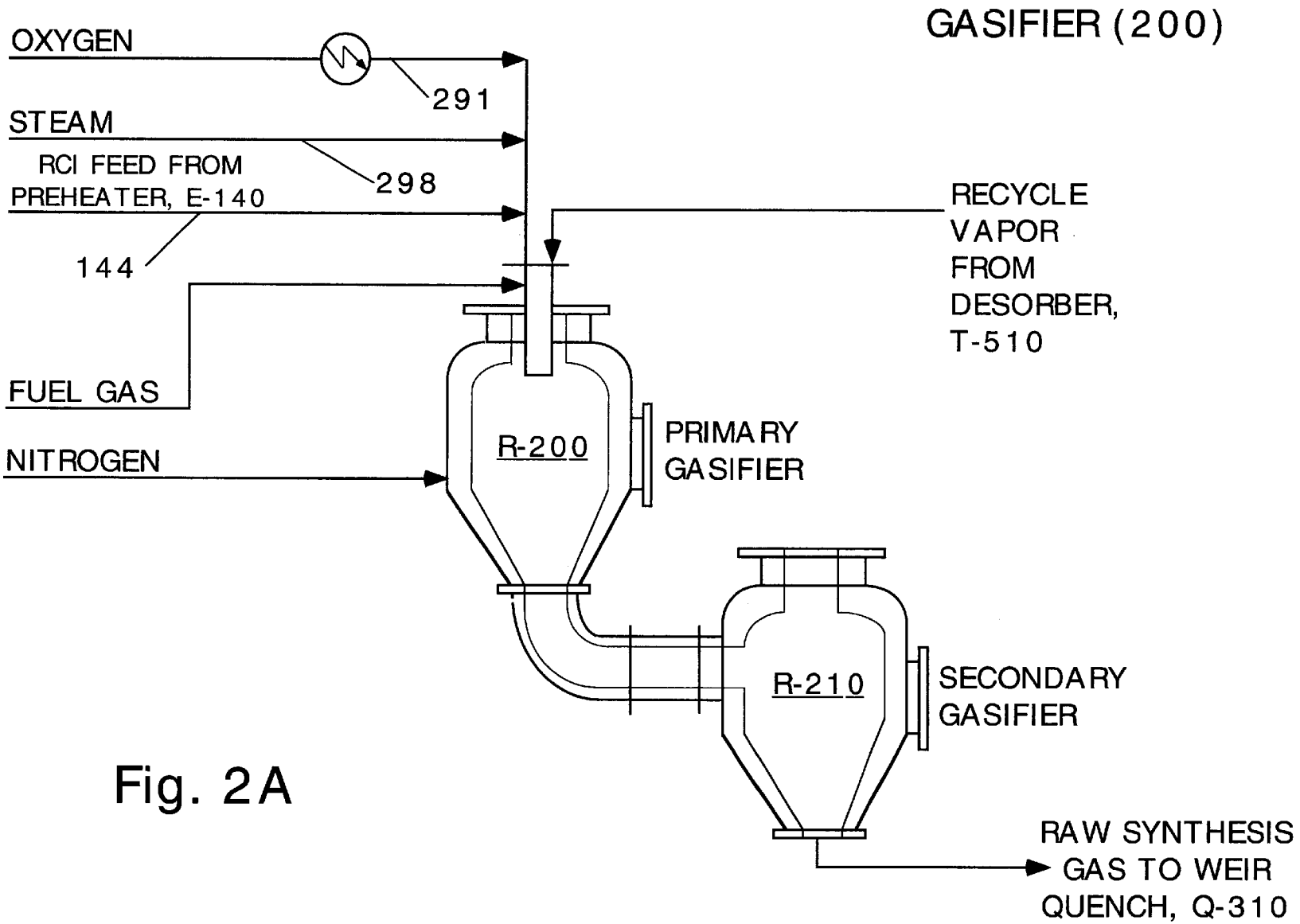
FIGS. 2A and 2B illustrate an embodiment of a gasifier for use in a gasification process for halogenated materials, as per FIG. 1.

An embodiment of a gasification process for halogenated materials is discussed first, for background purposes, as it offers a particularly apt application for the instant invention. The embodiment of the process is comprised of nine major processing areas, illustrated in the block flow diagram of FIG. 1.

1) Feed Preparation 100
2) Gasifier 200
3) Quench 300
4) Particulate Removal and Recovery 350
5) Aqueous HCl Recovery and Clean-up 400, 450
6) Syngas Finishing 700
7) Anhydrous Distillation 500
8) Anhydrous HCl Drying and Compression 600
9) Environmental 800

Review of the gasification embodiment helps to place the instant invention in perspective. The embodiment presumes a chlorinated organic (RCl), a typical halogenated material, as a feed material. Particular mention is made of the gasifier process, illustrated in FIGS. 2A and 2B, and of the products of the refractory for the example of FIG. 1.

Feed preparation area 100 provides for storage and pretreatment of various liquid RCl or halogenated material feeds to a gasifier. These feeds are preferably mixed in a feed tank from which they may be pumped to a grinder, cyclone and/or strainer in order to control the particle size of any entrained solids. The conditioned stream can then be forwarded through a preheater to be injected into a gasifier.

The gasifier area 200 of a preferred embodiment, as more particularly illustrated in FIGS. 2A and 2B and discussed in more detail below, consists of two reaction vessels, R-200 and R-210, and their ancillary equipment for the principal purpose of reforming the halogenated material, presumed herein to be RCl's. The RCl's or the like liquid stream 144 is atomized into a primary reactor R-200, preferably with a pure oxygen stream 291 and steam stream 298. In a harsh gasification environment the RCl or the like components are partially oxidized and converted to synthesis gas (syngas) comprised primarily of carbon monoxide, hydrogen chloride and hydrogen, with lesser amounts of carbon, water vapor and carbon dioxide as well as trace elements. The syngas preferably flows into a secondary reactor R-210 where all reactions proceed to completion, thus yielding very high conversion efficiencies for all halogenated species and minimizing undesirable side products, such as soot.

Hot gases from the reactor are preferably cooled in a quench area 300 by direct contact with a circulating aqueous stream. The reactor effluent syngas and recirculating aqueous stream are most preferably intimately mixed in a weir quench vessel. The mixture then preferably flows to a vapor-liquid separator drum from which a quenched gaseous stream passes overhead and a bottoms liquid is cooled and recycled to the weir quench.

Particulates in the gaseous stream passing overhead from the quench vapor-liquid separator, consisting primarily of soot, metals and metal salts, are preferably scrubbed from the gaseous stream in an atomizer or scrubber.

A particulate free syngas gaseous stream from the vapor-liquid separator scrubber is preferably introduced into an HCl absorption column 400. A gaseous stream of noncondensible syngas components pass through the absorber overheads and on to a syngas finishing area 700. HCl in the syngas stream introduced into the absorber is absorbed to form a concentrated aqueous acid bottoms stream. This high quality aqueous acid stream is preferably filtered and passed through an adsorption bed 450 to remove final traces of impurities, yielding a membrane grade aqueous HCl product. The product can be sold as is or pumped to an anhydrous distillation area 500 for the production of anhydrous HCl, as desired.

A caustic scrubber and syngas flare system make up at least portions of syngas finishing area 700. The caustic scrubber, or syngas finishing column, uses cell effluent in the lower section of the column to absorb final traces of HCl from the syngas stream. From thence the gas can be piped to the final consumer.

Figure 2B:
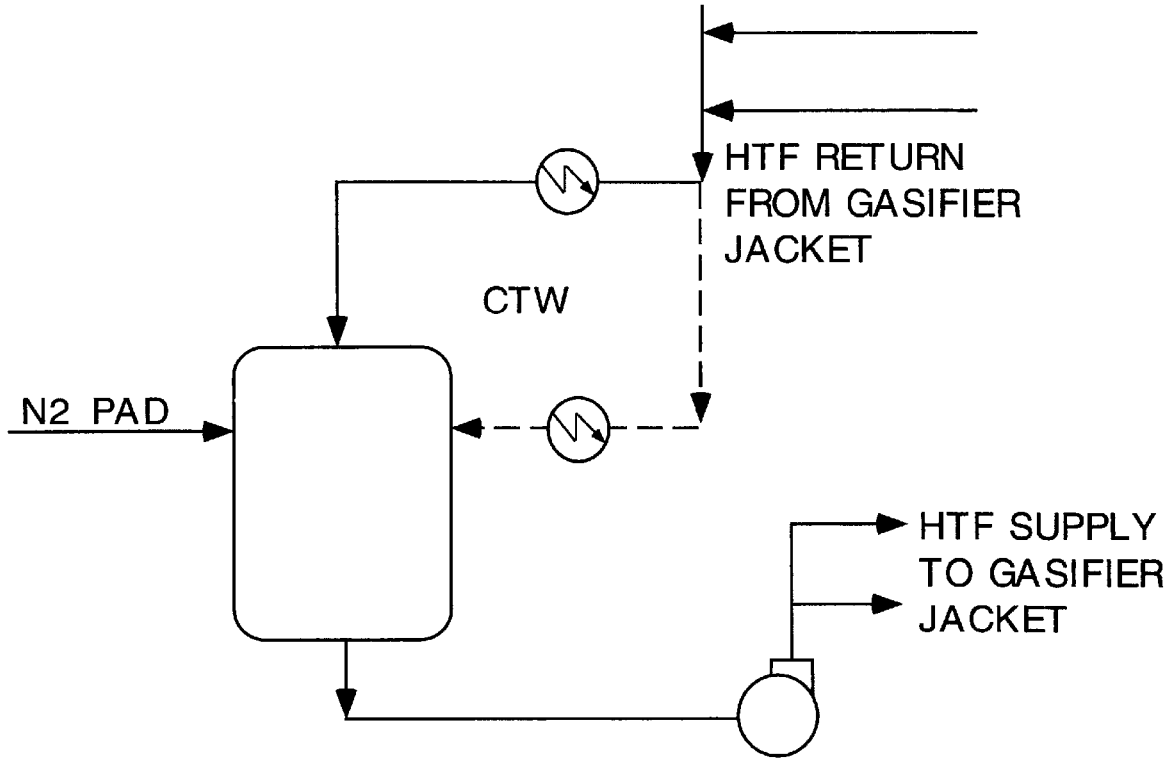
Figure 3:
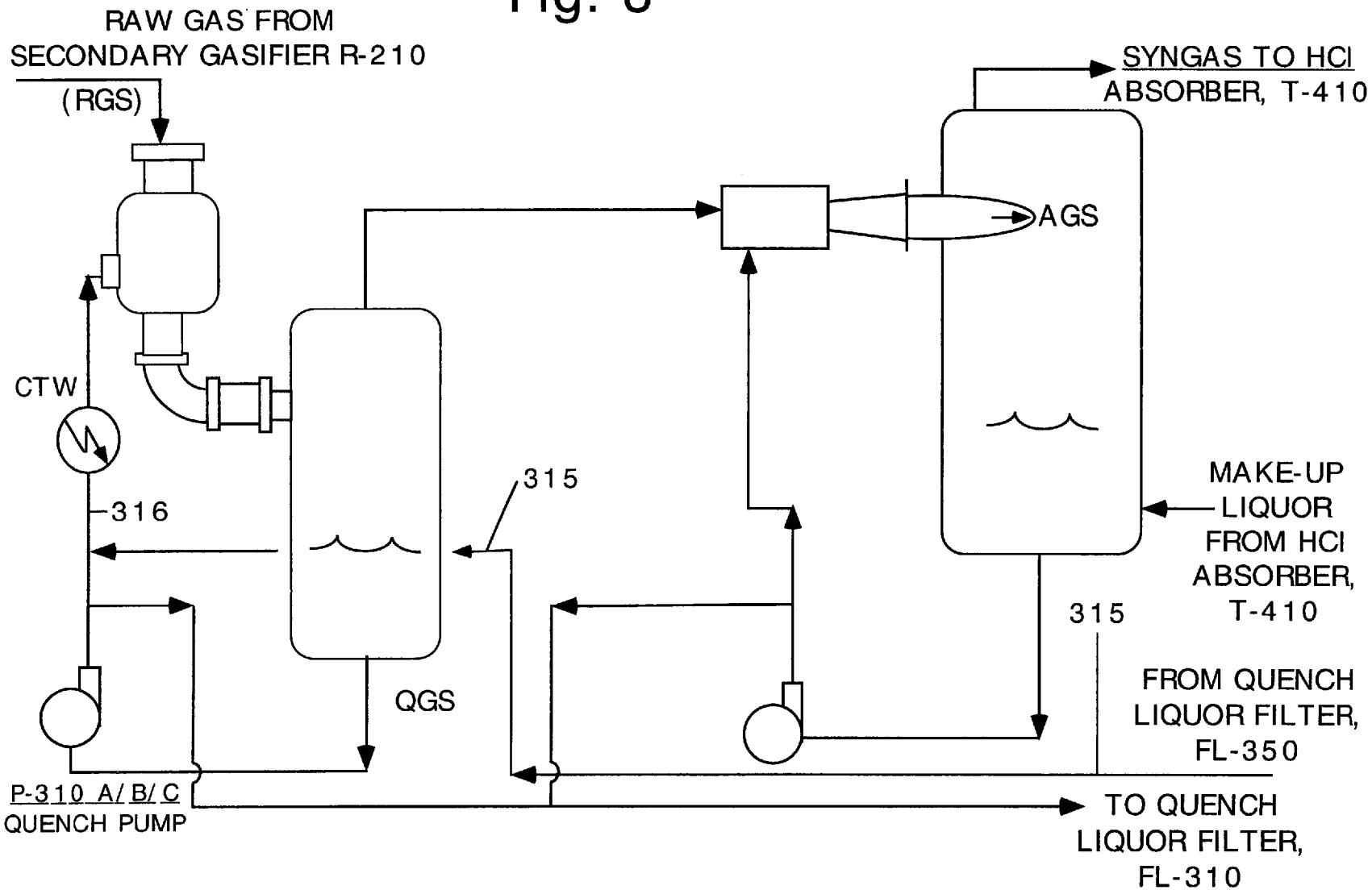
FIG. 3 illustrates a embodiment for a quench and particle removal unit, in general, for use in a gasification process for halogenated materials, as per FIG. 1.

Having reviewed now an embodiment of a gasification reactor process for halogenated materials in general, offering a prime use for the instant invention, the gasifier 200 will be reviewed in slightly more detail, as illustrated in FIGS. 2A and 2B, and the products of the gasification process will be briefly discussed.

Gasifier area 200, in a particularly preferred embodiment, as discussed above, consists of two reaction vessels R-200 and R-210 and their ancillary equipment for the principal purpose of halogenated feed material reformation. Because of the corrosive nature of HCl, both as a hot, dry gas and as a condensed liquid, reactor pressure vessels or shells and connecting conduits are preferably "jacketed" and may include connection with a closed heat transfer fluid circulation system for wall temperature control, as indicated in FIG. 2B.

Primary gasifier R-200, in the preferred embodiment illustrated, functions as a down fired, jet stirred reactor, the principal purposes of which is to atomize the liquid fuel, evaporate the liquid fuel, and thoroughly mix the fuel with oxygen, moderator, and hot reaction products. The gasifier operates at approximately 1450° C. and 75 psig. These harsh conditions insure near complete conversion of all feed components.

The reactions that take place in the gasifier R-200 are many and complex. The reaction pathways and kinetics are not completely defined nor understood. Indeed, for the numerous species that comprise the gasifier feed, the multiple reactions and their kinetics for each will be somewhat different. However, because of the extreme operating conditions in the gasifier, the gasification reactions can be fairly represented by the overall reactions defined below, in a close approach to equilibrium for most species.

RCl Partial Oxidation:

Chlorinated organics are partially oxidized to CO, $H_2$ and HCl.

$$C_vH_wCl_x+(v/2)O_2\rightarrow(v)CO+[(w-x)/2]H_2=(x)HCl$$

However, since the gasifier operates with a slight excess of oxygen above this stoichiometry, further oxidation occurs. Water vapor and carbon dioxide can also participate as oxidizers at gasification conditions.

$$C_vH_wCl_x+CO_2\rightarrow(v+1)CO+[(w-x)/2)]H_2+(x)HCl$$

$$C_vH_wCl_x+H_2O\leftrightarrows(v)CO+[1+(w-x)/2]H_2+(x)HCl$$

Further Oxidation Reactions:

$$CO+\tfrac{1}{2}O_2\rightarrow CO_2$$

$$H_2+\tfrac{1}{2}O_2\rightarrow H_2O$$

The oxidation reactions with oxygen, including the reaction $C_vH_wCl_x+(v/2)O_2\rightarrow(v)CO+[(w-x)/2]H_2=(x)HCl$, are highly exothermic, and thus provide the energy for driving the other reactions, maintaining the gasifier temperature as desired.

Thermal Decomposition Reactions:

In local fuel rich zones resulting from the less than perfect mixing inherent to any burner, thermal decomposition occurs in the absence of oxygen or oxidizing species.

$$C_vH_wCl_x\rightarrow C_r+(x)HCl+(v-r)CH_4+[w-x-4*(v-r)/2]H_2$$

where C is soot, and methane $CH_4$ is the simplest hydrocarbon molecule which is quite stable.

Gas Shift Reactions:

$CO+H_2O\leftrightarrows CO_2+H_2$, classic gas shift reaction, driven primarily by gas composition, pressure and temperature have limited effect within the narrow opening range of the gasifier.

$CH_4+H_2O\leftrightarrows CO+3H_2$, steam—methane reforming driven almost completely to the right at gasifier conditions.

Soot is also subject to partial oxidation reactions as described in paragraph 1 above, excluding the chlorine atom.

Other Reactions:

Due to the low partial pressure of oxygen in the gasifier, essentially all halogens, including chlorine as shown above, equilibrate to the hydrogen halide.

The secondary gasifier R-210 in the preferred embodiment functions to allow the reactions as described for the primary gasifier to proceed to equilibrium. The secondary gasifier R-210 operates at approximately 1400° C. and 75 psig. This is simply a function of the conditions established in the primary gasifier, less limited heat loss.

There are no specific controls for the secondary gasifier. Proper operation of the primary gasifier insures that the secondary gasifier is at the right temperature and composition mix to complete the gasification reactions.

The following represents typical operating performance of the gasifier system with respect to production of species other than the desired CO, $H_2$, and HCl:

| | |
|---|---|
| Exit gas $CO_2$ concentration: | 1.0–10.0 volume % |
| Exit gas $H_2O$ concentration: | 1.0–10.0 volume % |

EXAMPLE 1

The following feed streams are fed to a gasifier in accordance with the above embodiment through an appropriate mixing nozzle:

| | |
|---|---|
| Chlorinated organic material: | 9037 kg/hr |
| Oxygen (99.5% v purity): | 4419 kg/hr |
| Recycle vapor or moderator: | 4540 kg/hr |

[58.8 wt % water vapor, 41.2 wt % hydrogen chloride]

The resulting gasification reactions result in a synthesis gas stream rich in hydrogen chloride and chamber conditions of approximately 1450° C. and 5 barg.

In accordance with the above embodiment, the following vapor stream might be fed to a quench vessel: 41,516 lb/hr (38.5 wt % CO, 37.3 wt % HCl, 10.8wt % $CO_2$, 8.9wt % $N_2$, 1.7wt % $H_2$). The functionality of a quench requires that a heat balance be maintained and that the liquid flowrate remains approximately within an appropriate range as described above. This range might be approximately 500 gpm to 1500 gpm for an acceptable quench performance in accordance with the above described gasification process embodiment. The quench operates at gasifier system pressure, which might be approximately 75 psig. Inlet temperature would be anticipated to be normally ~1400° C. and exit temperature ~100° C. Quench liquid flow would be anticipated to be ~1400 gpm at 60° C. from a cooler at base design conditions for a gasification process embodiment above described.

Quench liquid supplied to a weir quench is preferably a circulating solution. The two-phase stream that exits a weir quench chamber is anticipated to flow to a vapor-liquid separator. Liquid droplets would be separated from the vapor stream—allowing a relatively liquid free vapor to pass overhead into a particulate scrubbing system. Collected liquid can be pumped through a graphite plate and frame heat exchanger or other suitable exchanger and back to the weir quench as quench liquor. This exchanger rejects the heat duty of quenching the gas from 1400° C. to approximately 100° C.—which is approximately 35 MMBTU/hr at base conditions. The circulation rate and exchanger outlet temperature can be varied to achieve a desired quench outlet temperature within operational constraints of a weir device as described above, and within the boundaries further defined by the water balance and contaminant removal efficiencies.

Due to vigorous gas-liquid contact in a quench, the scrub liquid is very near equilibrium with the gas phase. That is, it is typically 30–32wt % HCl at base design conditions. Make-up liquor for the system can come from a particulate scrubber, which is at a high enough HCl concentration to avoid absorbing HCl from the gas, but rather letting it pass through where it can be captured as saleable acid in the absorber. As described above, liquid flow is ~1400 gpm at 60° C. from the cooler at base design conditions. Table 1 is a mathematical model run of the quench area 300 of FIG. 1, illustrating material and energy balances.

Literature as well as experimental data reveal that normal materials used in a quench system, such as described above, show signs of corrosion at the vapor/liquid interface in the vessel. Either a material needs to be found that can hold up to these conditions or an alternative means needs to be devised in order to ensure that corrosion is not as severe and unrelenting a problem at this interface in a quench system during operation. The instant invention teaches solutions to this problem.

Figure 4:
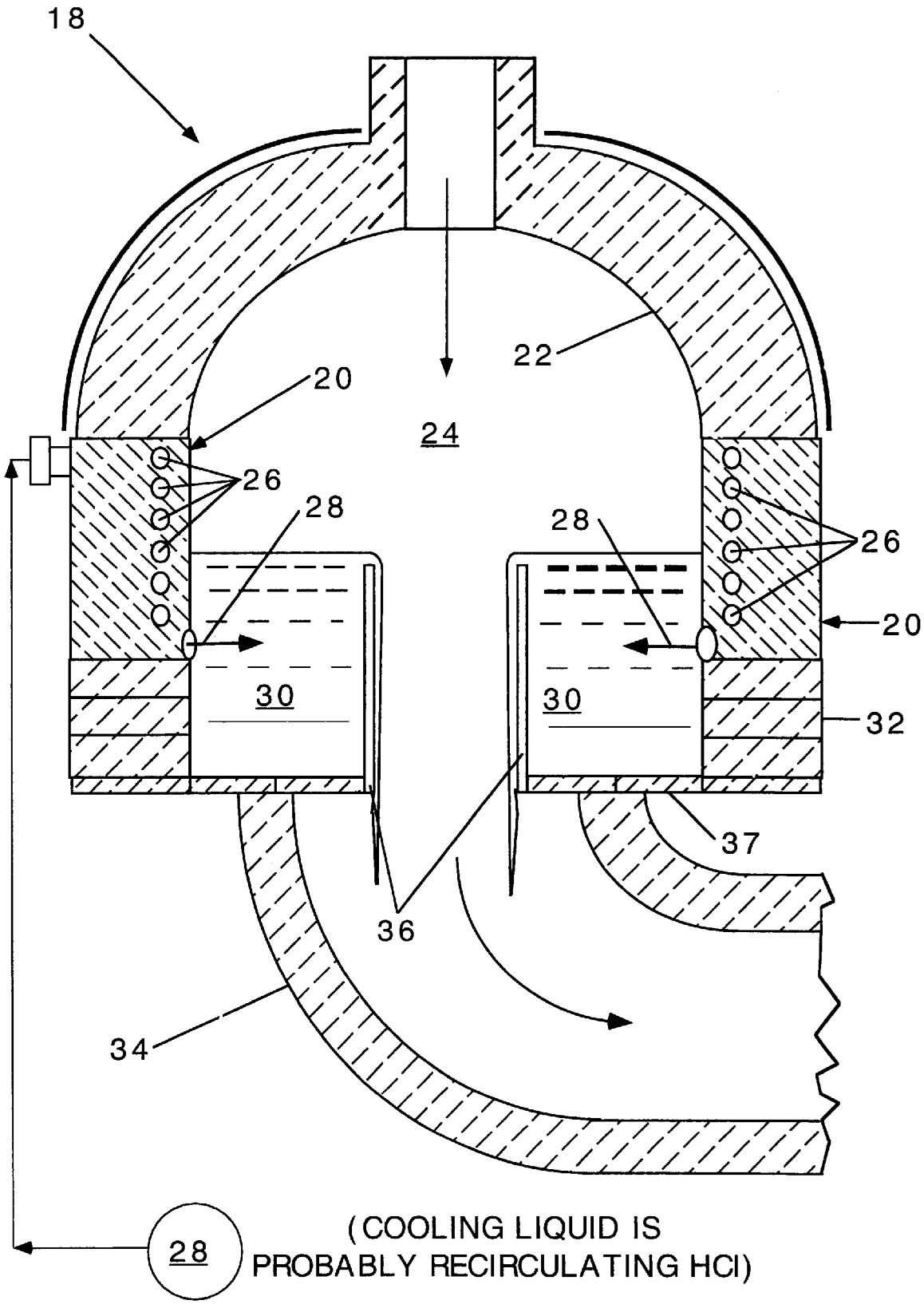
FIG. 4 illustrates an embodiment of the present invention showing a cooled carbon block or ring located in vessel wall portions proximate a liquid/gas interface level.

A first preferred embodiment of the instant invention, as illustrated in FIG. 4, comprises a cooled carbon or graphite block or ring 20, inserted as a liquid/gas interface material into a vessel 18 wall portion proximate an anticipated liquid/gas interface area. Block or ring 20 is inserted into vessel 18 wall at approximately the level of the top of weir 36 in the weir quench embodiment, which is where the gas/liquid interface level should occur. The block might be two to three feet in height to adequately cover possible interface levels. The height of the block and situation of the block in the vessel wall should be selected to cover anticipated gas/liquid interface levels for the vessel.

Figure 9:
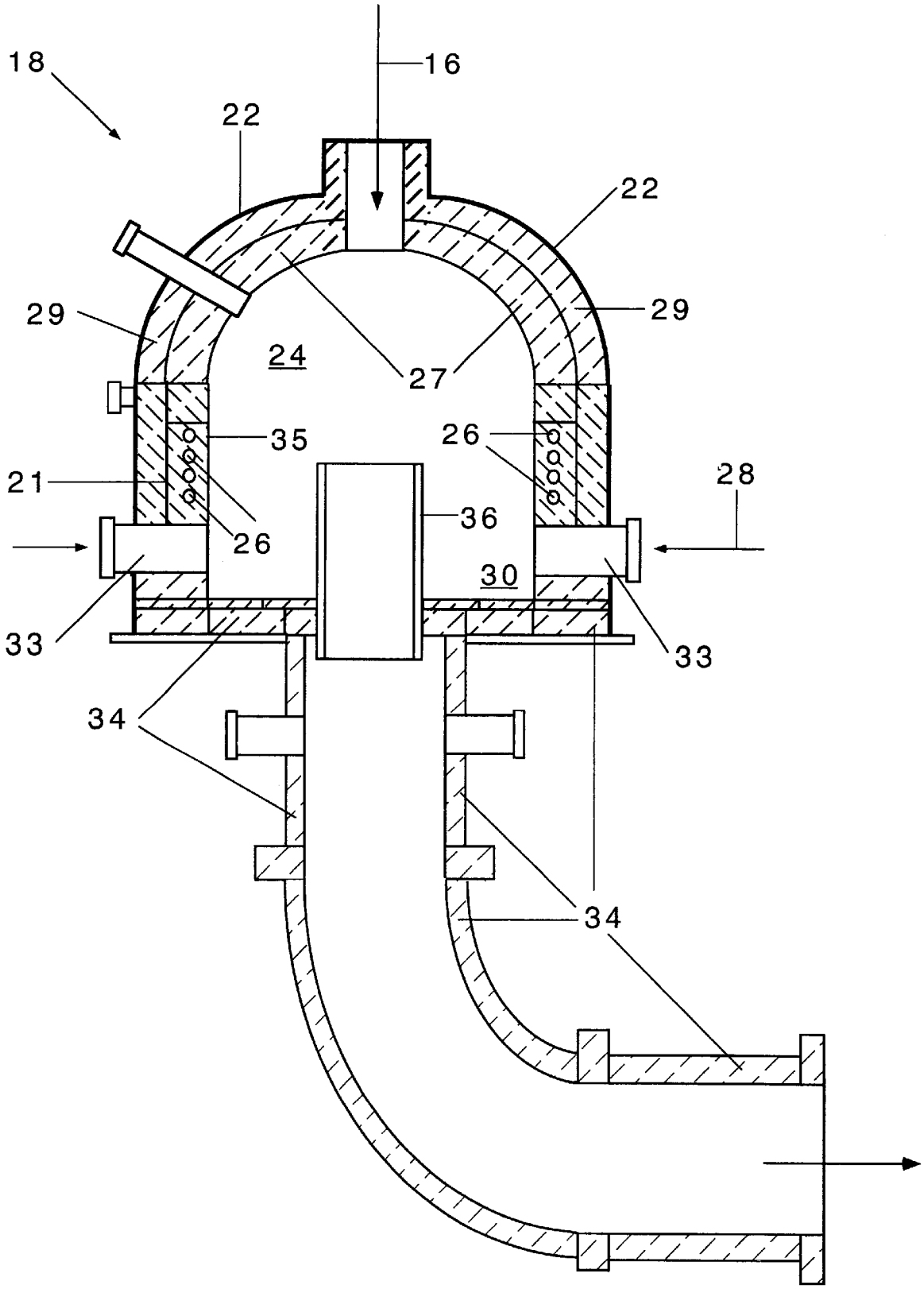
FIG. 9 illustrates a weir quench having a membrane cooled wall located proximate a liquid/gas interface level.

Upper inside wall portions of vessel 18, such as wall 22 indicated in FIG. 4, include hot face materials. Hot face materials include materials capable of facing hot gases, such as hydrogen halide gases at temperatures of approximately 1450° C. Hot face materials might include $Al_2O_3$, or high alumina refractory brick. Vessel 18 hot face wall may also be covered with an insulating brick outside of the hot face refractory brick, as more clearly indicated in FIG. 9. As indicated in FIG. 9, in one embodiment a hot alumina refractory brick comprising an upper wall portion of vessel 18, might be 4½ inches thick and of greater than 90% $Al_2O_3$, while an outer insulating brick might be approximately 9 inches thick. The lower cooler vessel region could be covered with an acid tile of approximately 1½ inches thick. Vessel 18 might also be covered with a pressure vessel or shell such as carbon steel coated with chilastic CP79 or the equivalent. The pressure vessel might also be jacketed. Lower portions of the upper region of vessel 18 are portions anticipated to be covered by the quench cooling liquid, such as an aqueous hydrogen halide liquid, so are preferably comprised of a material able to withstand corrosion from contact with the liquid acid. The lower portions 32 of vessel 18 wall might be comprised of silicon carbide or $SiC_4$. Lower vessel walls 34 leading to an outlet of vessel 18 might be comprised of acid brick or ceramic lining materials. Plate 37 through which weir 36 extends might preferably be formed of a reaction bonded silicon carbide, while weir 36 might preferably be comprised of quartz. FIGS. 9 and 4 illustrate possible vessel wall construction.

Returning to the embodiment of FIG. 4, block 20 has passages 26 within for circulating a small amount of cooling fluid 28, possibly recycled aqueous hydrogen halide liquid. Preferably, passages 26 in block 20 circulate cooling liquid 28 near the inside surface of the block in order to keep block wall temperature normally less than 450° C. The graphite or carbon block 20 defines conduits or passages 26 that allow a cooling fluid or liquid to flow through the wall while the inside surface of the block itself remains dry. The liquid 28 used to cool the wall preferably discharges from passages 28 into a vessel liquid retaining area 30, below an anticipated liquid level in the vessel.

A second embodiment, illustrated in FIG. 9 (not drawn to scale and shown upon its side), includes a cooled membrane wall 21. A membrane wall is known in the art of refractory design. A membrane wall typically employs one or more layers of a refractory 35 upon a tubular membrane 21 construction. The membrane can be constructed of any number of conduits or passages 26 (usually helically wound tubes, or similar) for circulating a fluid heat control substance. The conduits together make up an interior "membrane" barrier. The membrane and refractory materials are installed within the vessel, usually in panels, (typically leaving a small space between the membrane and a vessel wall). A heat transfer fluid flows through the membrane conduits to absorb heat from quench chamber 24, thereby limiting vessel wall temperatures. The conduits of a membrane are typically formed of an alloy, such as Hastelloy Alloy B-2, C-276, Tantalon or similar. The membrane is typically faced with a castable or plastic refractory 35.

Figure 5:
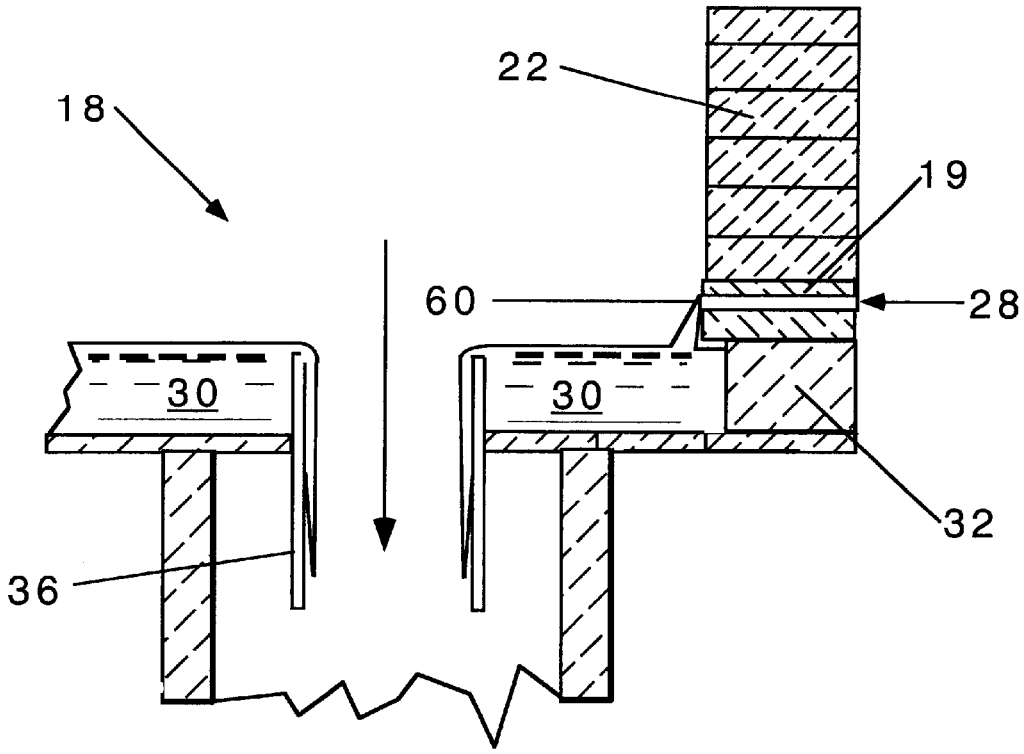
FIG. 5 illustrates a graphite ring embodiment for the instant invention.

A third embodiment, illustrated in FIG. 5, includes a cooled distribution ring 19. Graphite ring 19 is placed upon an interior vessel 18 wall above an anticipated liquid/gas interface level. The ring preferably contains small ports 60 and one or more passageways 33 that enable cooling liquid 28 to pass through the wall and ring and to run down the inside of the ring wall, which keeps the wall wet and cooled. The cooled liquid, possibly aqueous hydrogen halide liquid, would initially pass through channel(s) 33 and flow inward to a quench liquid distribution area. Liquid 28 flows from the outside to the inside of the ring structure and then through ports 60 and runs down the surface of the ring wall, preventing hot process gas from contacting the graphite wall. The fluid flow in ports 60 transfers heat from, and cools, the dry wall region immediately above ports 60. The liquid then collects in the liquid collection area 30 of the vessel.

Figure 6:
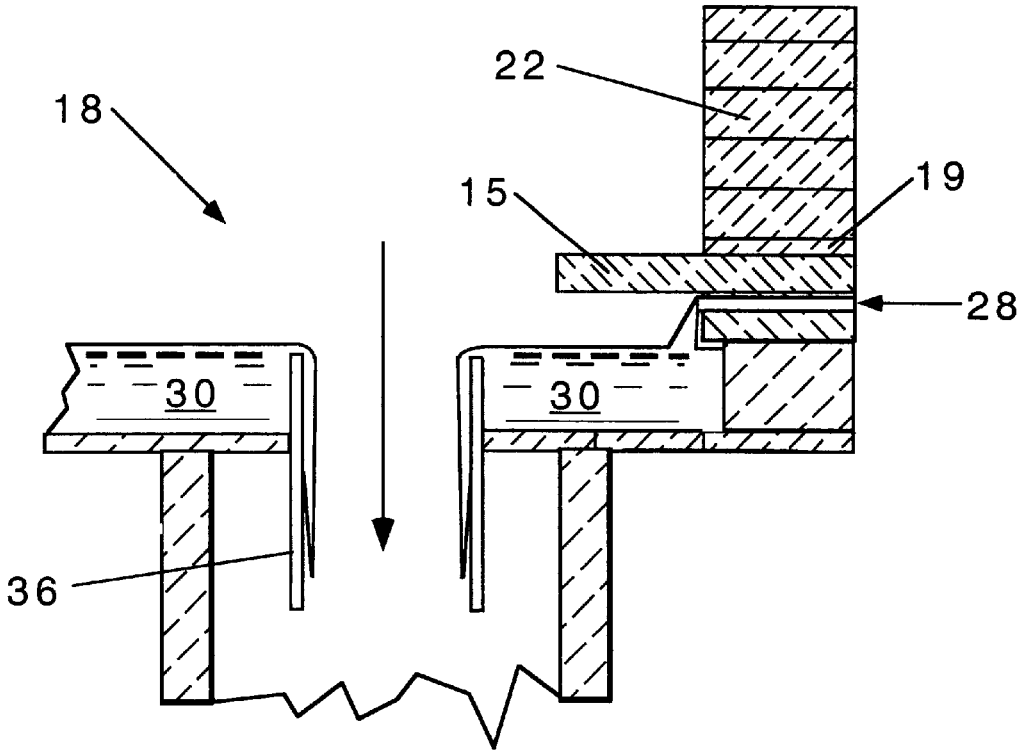
FIG. 6 illustrates a graphite splash baffle for use with a graphite ring, as illustrated in FIG. 5.

FIG. 6 illustrates a possible addition to the third embodiment, namely a cooled distribution ring 19 having a graphite baffle 15. In addition to a cooled ring 19, where liquid 28 overflows down a side of the wall keeping the wall cool and wet along an anticipated gas/liquid interface, a baffle 15 is placed above the area where the liquid is distributed, for preventing the liquid from splashing onto the dry wall 22 portion above.

Figure 10:
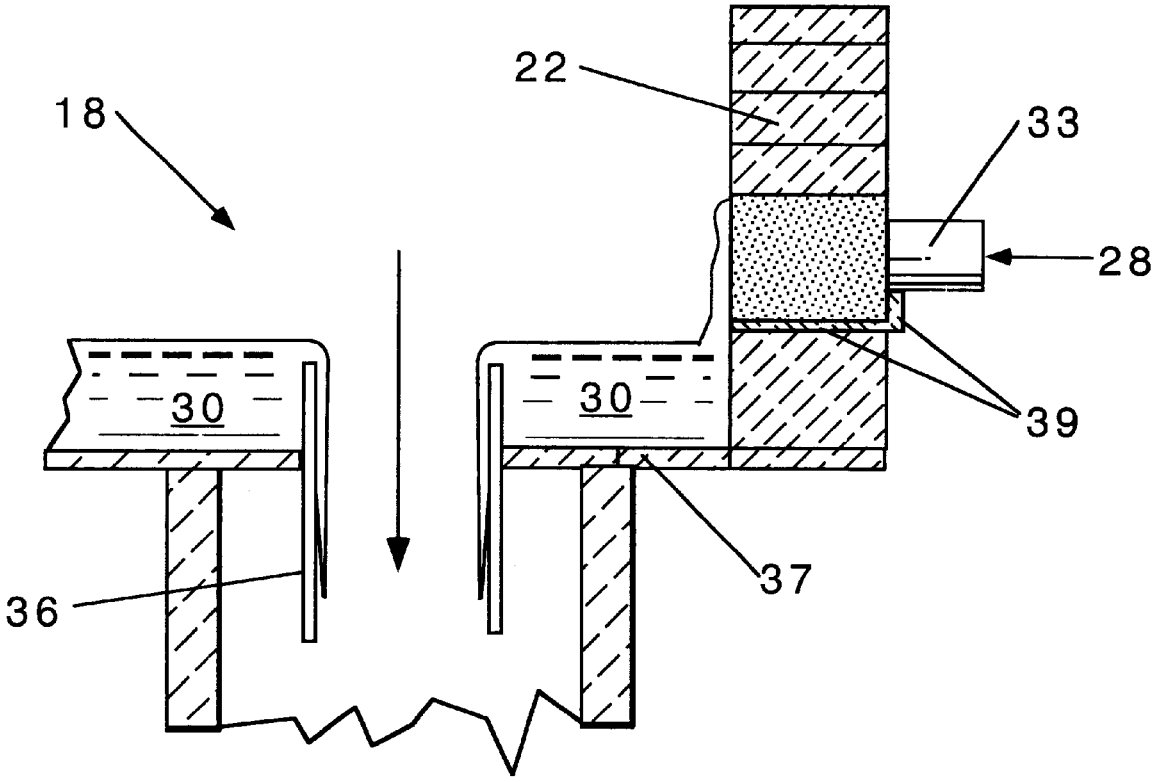
FIG. 10 illustrates a vessel embodiment having a porous ceramic wall located proximate a liquid/gas interface level in a vessel.

A fourth embodiment illustrated in FIG. 10 is analogous to the embodiment of FIG. 5. The embodiment of FIG. 10 illustrates a seeping porous ceramic wall block or ring 20. Cooling liquid 28 is placed in communication with a portion of the seeping porous ceramic material. Pumping of cooling liquid 28 through conduit 33 to seeping porous ceramic wall 20 causes the cooling liquid to seep through the porous ceramic wall and emerge on inside portions of the wall where, as with the embodiment of FIG. 5, the liquid flows down the inside surface of the seeping porous ceramic wall wetting and cooling the wall and keeping the wall out of contact with the hot dry process gas. As with the embodiment of FIG. 5, the cooling liquid after seeping through the porous ceramic wall and falling down the wall surface collects in a cooling liquid collection area 30 of the vessel 18. Surfaces of the block or ring that are not desired to seep are finished, as with a film 39, to render them impermeable.

Figure 12A:
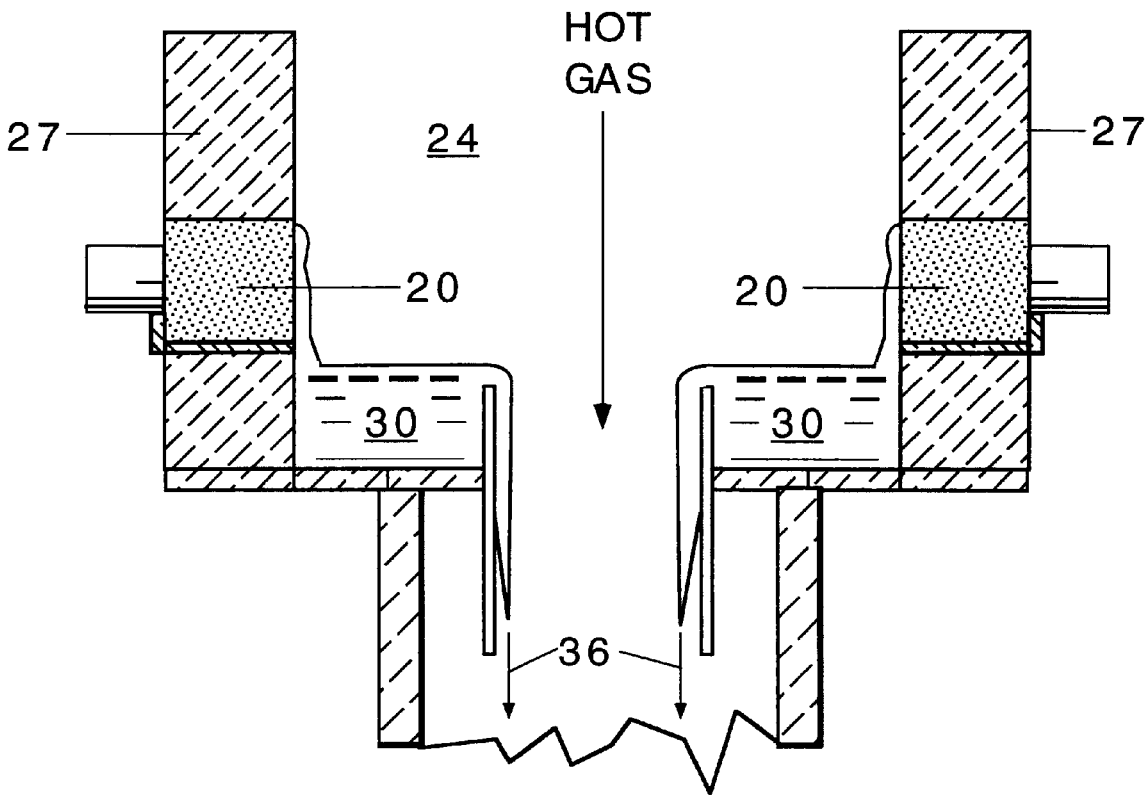
FIGS. 12A–12C illustrate a non-cooled dry wall interface material embodiment of the instant invention.
Figure 12B:
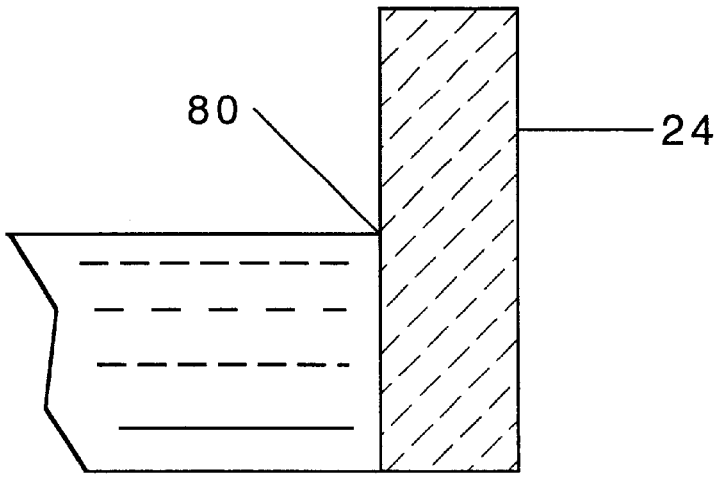
Figure 12C:
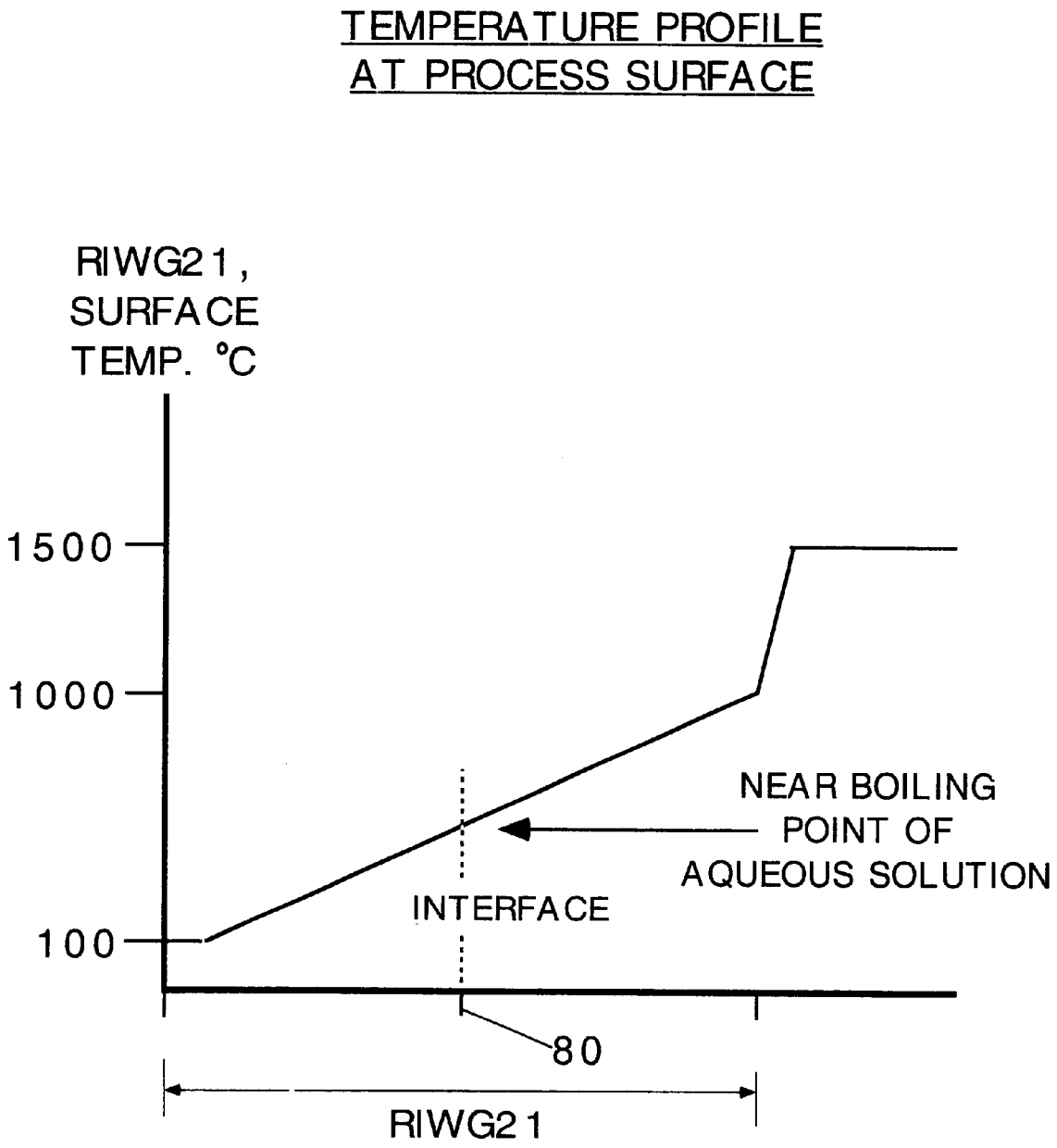

A fifth embodiment illustrated in FIGS. 12A–12C comprises a non-cooled hot wall. A block or ring 20 of SiC of graphite or silica or the like is placed at, above and below the interface level 80. Contact with the liquid below interface level 80 cools the block above the interface level, through heat transfer within the block itself, to temperatures within the block material's capacity to withstand a wet corrosive environment. The block is sufficiently high such that the wall above the block is dry.

Figure 7:
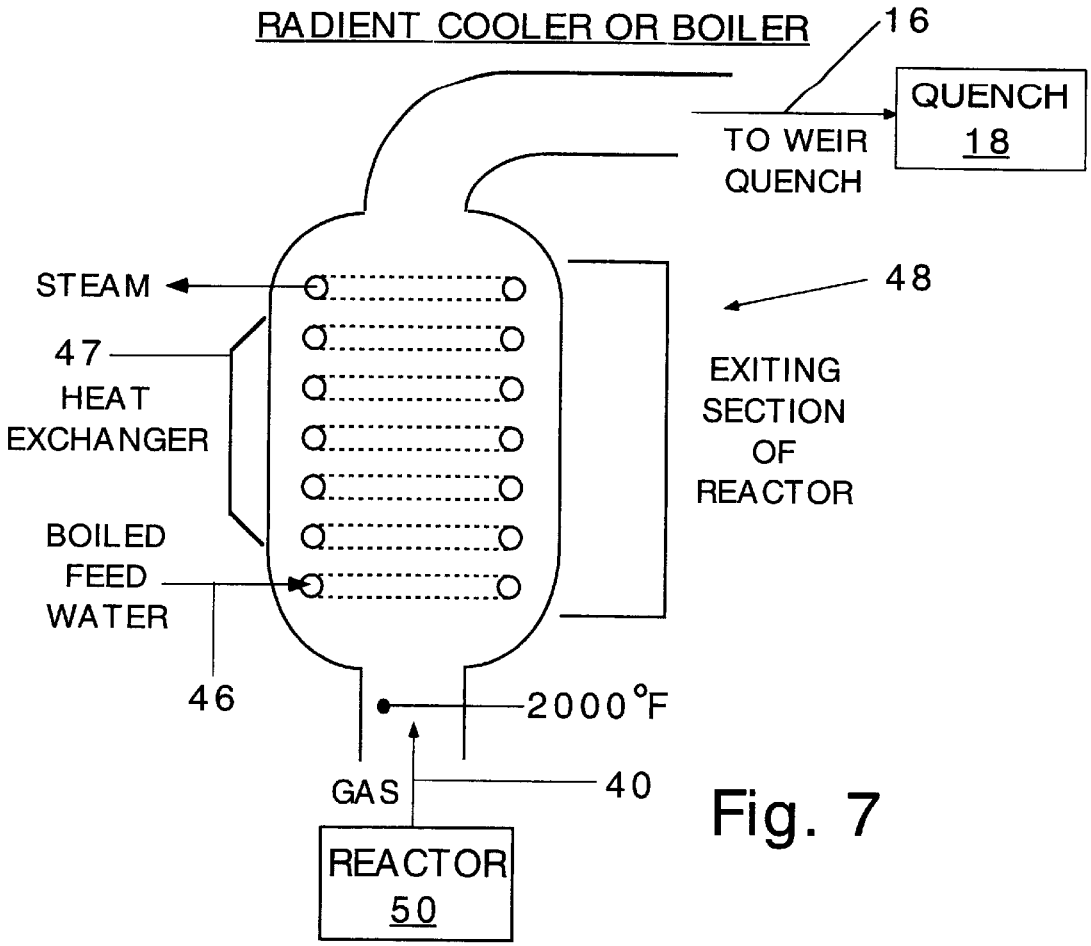
FIG. 7 illustrates a radiant cooler for use between a gasification reactor vessel and a quench vessel.

In a distinct approach, a sixth embodiment, as illustrated in FIG. 7, includes a radiant cooler 48 situated between a gasifier vessel 50 and a quench vessel 18. The radiant cooler 48 is placed in an exiting section of a gasifier reactor 50 or a separate vessel. The purpose of this system is to cool the gaseous stream temperature leaving reactor 50 below 1093° C. The significance of the cooler gas temperature is that there are known materials of construction that can be used for a downstream quench vessel 18 which can withstand this environment in both the vapor and liquid phase. There would no longer be a special concern for corrosion at a vapor/liquid interface region. (In general, herein, 1093° C. may be rounded to 1100° C. for convenience; 1100° C. is an approximate number.) The radiant coolant 47 is basically a heat exchanger and preferably uses boiler feed water 46 as a heat exchange fluid.

Figure 11:
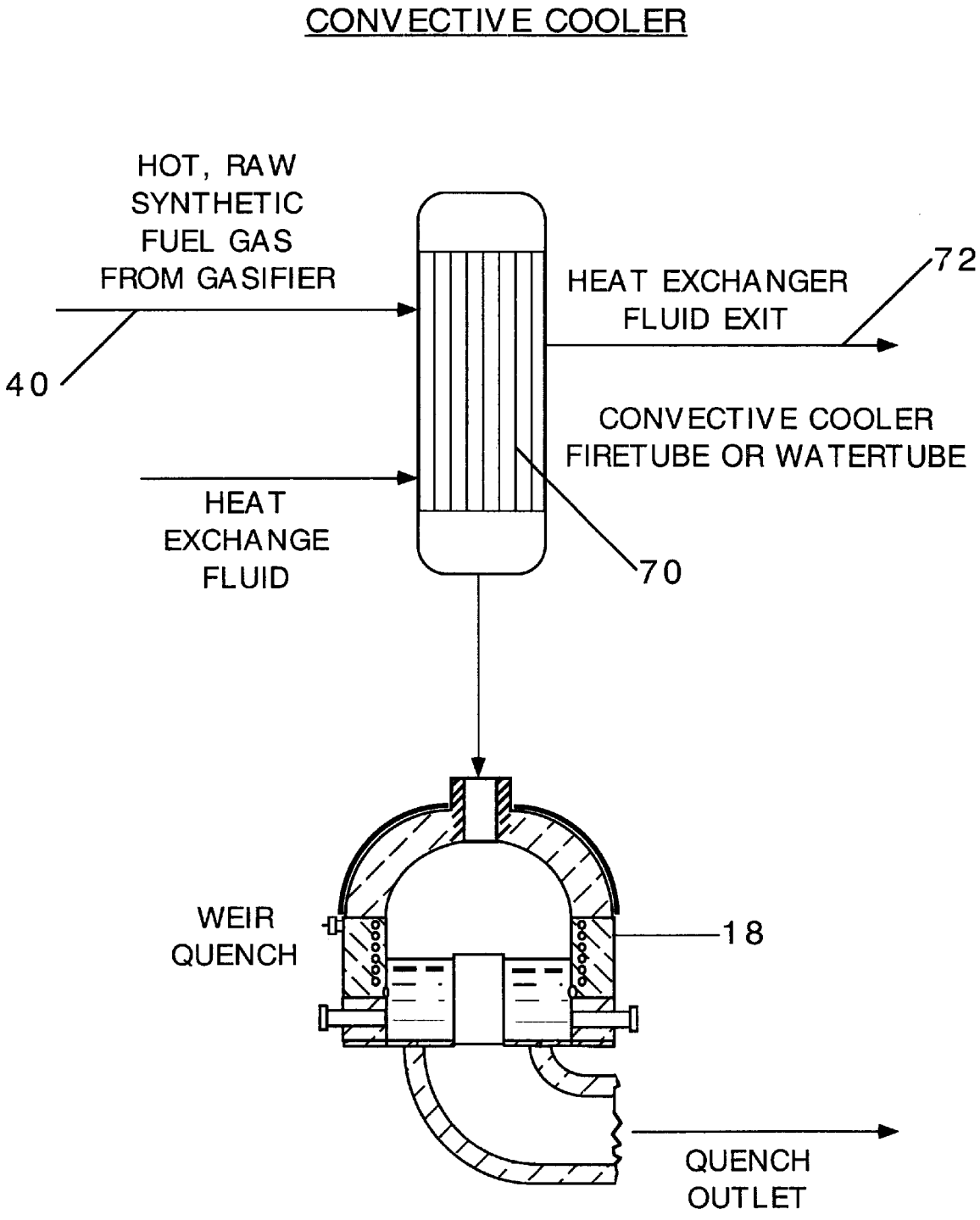
FIG. 11 illustrates a convective cooler for use between a reactor vessel and a quench vessel.

A convective cooler, illustrated in FIG. 11, could also be used for this cooling application with appropriate design implemented to control tube 70 wall temperatures.

Figure 8:
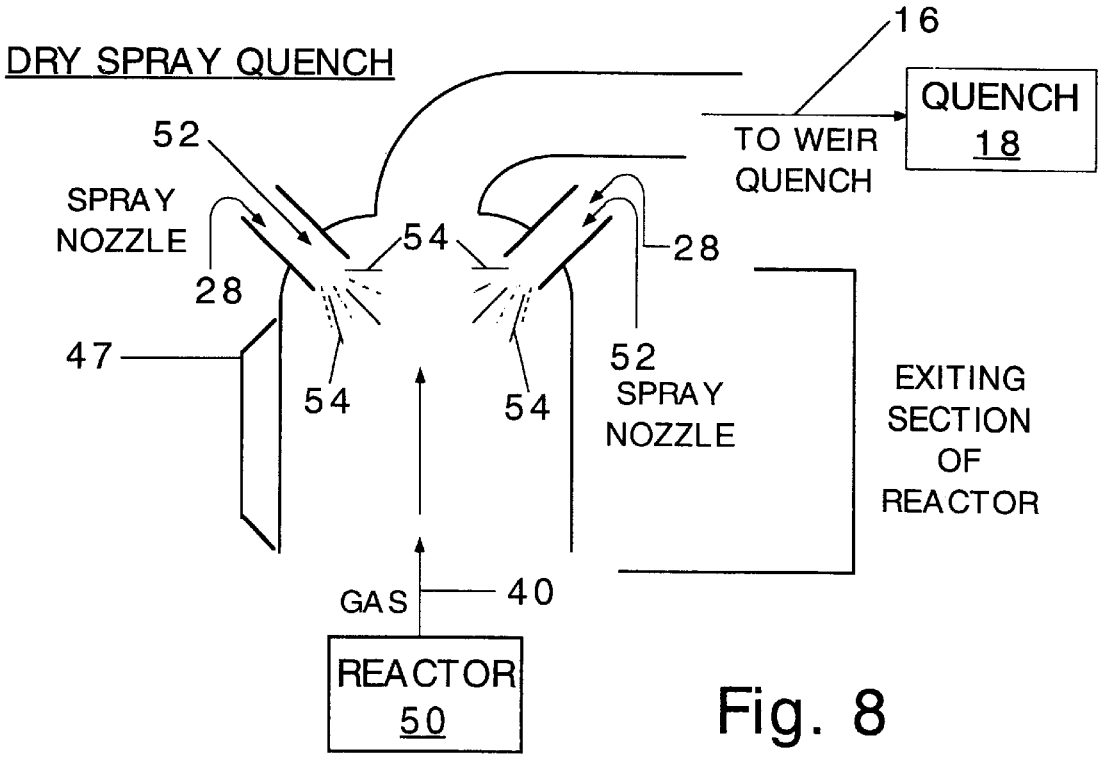
FIG. 8 illustrates a dry spray quench for use between a gasification reactor vessel and a quench vessel.

In an eighth embodiment, similar to the sixth and seventh embodiments and illustrated in FIG. 8, a dry spray quench is situated between a reactor vessel 50 and a quench vessel 18. Spray nozzles 52 inserted in an exiting section 42 of reactor 50, or in a separate vessel, cool gaseous stream 40 leaving the reactor 50 to below 1093° C. The spray liquid 28 evaporates, and spray nozzles 52 are arranged so that the liquid 54 does not impinge on the dry wall of the exiting section 42 nor any dry refractory surface. This is accomplished through careful atomization and geometric design of the system. Recycled aqueous quench liquid would preferably be used as the cooling medium 28 in the spray nozzles. Again, the significance of the cooler gas temperature is that there are known materials of construction for a downstream quench vessel that can withstand this environment in both a vapor and a liquid phase. There would no longer be a special concern for corrosion at the vapor/liquid interface region.

It is preferred in all embodiments to keep the pressure vessel wall temperature of vessel 18 above around 200° C., in order to prevent vapors from condensing on the wall thus leading to possibly significant corrosion.

From review of the above embodiments it can be seen that while currently known materials of construction cannot easily withstand the conditions of both a hydrogen halide vapor and liquid environment at the excessive temperatures of the reactor (~1450° C.), the techniques of the instant invention solve the problem of corrosion from the vapor and liquid environment in a subsequent vessel, such as a quench vessel, largely allowing the use of a known materials of construction for the vessel.

Embodiments that modify the vessel wall construction, at least at the liquid/gas interface level, have the advantages of eliminating a need for an upstream cooling system, such as spray nozzles or radiant cooling or convective cooling. Those embodiments create intimate gas/liquid mixing for thorough quenching with a simple yet robust construction. In a weir quench vessel capacity can be increased or decreased by varying the diameter or the number of weir tubes. Solutions embodying weir quench vessel construction wall designs further offer a strictly limited, controlled liquid/vapor interface area.

The interior cooled graphite ring or block design and the cooled membrane wall design are vessel design solutions wherein internal cooling passages maintain dry gas contacting skin temperatures at acceptable levels. The exterior cooled distribution ring or seeping porous ceramic wall produce a solution of vessel design that provides for limiting hot gas contact with wet wall portions. The surface is kept cool and protected due to the heat transfer action of flowing liquid over the inside surface of the graphite wall.

The radiant cooler, convective cooler and spray nozzle concepts, in contrast, offer the advantages of eliminating vessel wall material of construction issues, even for the critical vapor/liquid interface area. The principal purpose of the cooler or nozzle is not heat recovery but rather temperature control for subsequent combination of the gaseous stream with a quench vessel downstream from a reactor.

The foregoing disclosure and description of the invention are illustrative and explanatory thereof, and various changes in the size, shape, and materials, as well as in the details of the illustrated system may be made without departing from the spirit of the invention. The invention is claimed using terminology that depends upon a historic presumption that recitation of a single element covers one or more, and recitation of two elements covers two or more, and the like.

What is claimed is:

1. A vessel for quenching gases having a temperature in excess of 1100° C. by contact with an aqueous corrosive liquid, comprising:

an upper vessel wall portion lined with a hot face material capable of withstanding hot dry gas at temperatures in excess of 1100° C.;

a lower vessel wall portion in contact with an aqueous corrosive liquid; and a membrane wall portion located within a vessel wall proximate an anticipated liquid/gas interface level, the membrane wall having internal channels for circulating a cooling fluid.

2. A vessel for quenching gases having a temperature in excess of 1100° C. by contact with an aqueous corrosive liquid, comprising:

an upper vessel wall portion lined with a hot face material capable of withstanding hot dry gas at temperatures in excess of 1100° C.;

a lower vessel wall portion in contact with an aqueous corrosive liquid; and a carbon block wall portion located within a vessel wall proximate an anticipated liquid/gas interface level, the block having internal passageways for circulating a cooling fluid.

3. A vessel for quenching gases having a temperature in excess of 1100° C. by contact with an aqueous corrosive liquid, comprising:

an upper vessel wall portion lined with a hot face material capable of withstanding hot dry gas at temperatures in excess of 1100° C.;

a lower vessel wall portion in contact with an aqueous corrosive liquid; and a graphite ring wall portion, located within a vessel wall proximate an anticipated liquid/gas interface level, the ring being in communication with, and having ports for discharging, a cooling fluid therethrough.

4. The vessel of claim 3 wherein the ring and ports are structured to discharge cooling fluid substantially down vessel wall portions below the ring.

5. The vessel of claim 4 that includes a graphite splash baffle attached to a vessel wall and extending inwardly over the ring ports.

6. The vessel of claims 1, 2 or 3 wherein the cooling fluid includes an aqueous hydrogen halide liquid.

7. The vessel of claims 1, 2 or 3 wherein the cooling fluid is recirculated liquid from a downstream vessels of the process.

8. The vessel of claim 6 wherein the hydrogen halide liquid includes hydrogen chloride.

9. Apparatus for quenching a hot gaseous stream, comprising;

a reactor for discharging a gaseous stream at temperatures in excess of 1300° C.;

a quench vessel in fluid communication with the reactor for receiving the gaseous stream and contacting the gaseous stream with a corrosive aqueous liquid; and means located between the reactor and the quench vessel for cooling an exiting refractory gaseous stream to below 1100° C.

10. The apparatus of claim 9 wherein the means for cooling includes a radiant cooler.

11. The apparatus of claim 9 wherein the means for cooling includes a dry spray quench.

12. The apparatus of claim 9 wherein the means for cooling includes a connective cooler.

13. The apparatus of claim 11 wherein the means for cooling is in fluid communication with a cooling fluid.

14. The apparatus of claim 13 wherein the cooling fluid includes liquid recycled from a downstream process.

15. The apparatus of claims 1, 2, 3, or 9 wherein the vessel includes a weir quench.

16. A method for quenching hot gas, comprising:

discharging gas at temperatures in excess of 1100° C. into a quench vessel;

discharging a corrosive aqueous liquid into the quench vessel; and cooling vessel wall portions around an anticipated liquid/gas interface level with a cooling fluid.

17. The method of claim 16 that includes cooling by passing a cooling fluid within wall portions.

18. The method of claim 16 that includes cooling by passing a cooling fluid down inside surfaces portions of a vessel wall.

19. The method of claim 16 that includes cooling with a cooling fluid that includes an aqueous hydrogen halide liquid.

20. A method for quenching hot gas, comprising:

discharging gas from a reactor vessel at temperatures in excess of 1300° C.;

cooling discharging gas to below 1100° C.; and communicating cooled discharged gas to a quench for cooling to temperatures of below 200° C. by contacting the gas with a corrosive aqueous liquid.

21. The method of claim 20 that includes cooling discharging gas with a radiant cooler.

22. The method of claim 20 that includes cooling discharging gas with a dry spray quench.

23. The method of claim 20 that includes discharging hydrogen halide gas from a reactor.

24. The method of claim 20 that includes contacting the gas with aqueous hydrogen halide liquid.

* * * * *